United States Patent [19]

Beauchamp

[11] 4,187,137

[45] Feb. 5, 1980

[54] METHOD FOR FORMING A COMPOSITE CONTAINER INCLUDING A PERFORATED LABEL LAYER

[75] Inventor: Ronald A. Beauchamp, Creve Coeur, Mo.

[73] Assignee: Boise Cascade Corporation, Boise, Id.

[21] Appl. No.: 888,783

[22] Filed: Mar. 21, 1978

Related U.S. Application Data

[62] Division of Ser. No. 789,084, Apr. 20, 1977.

[51] Int. Cl.[2] ..... B65H 8/00

[52] U.S. Cl. ..... 156/195; 206/633; 229/4.5

[58] Field of Search ..... 156/195, 252, 253; 229/4.5; 206/627, 629, 633

[56] References Cited

U.S. PATENT DOCUMENTS

| | | | |
|---|---|---|---|
| 3,241,739 | 3/1966 | Ahlemeter | 229/4.5 X |
| 3,382,132 | 5/1968 | Kugler | 229/4.5 X |
| 3,409,206 | 11/1968 | Slouka | 229/4.5 X |
| 3,981,433 | 9/1976 | Thornhill et al. | 206/633 X |
| 4,100,846 | 7/1978 | Reid | 156/195 X |

FOREIGN PATENT DOCUMENTS

| | | | |
|---|---|---|---|
| 930792 | 7/1963 | United Kingdom | 229/4.5 |

*Primary Examiner*—David A. Simmons
*Attorney, Agent, or Firm*—Lawrence E. Laubscher

[57] ABSTRACT

A composite container is disclosed that includes a helically-wound label layer which contains a line of perforations that extends circumferentially adjacent and spaced from a metal end closure member, thereby to define a line of tear along which the label layer may be torn from the container. By the provision of the perforated tear line, the requirement of a collar cut in the container is avoided, thereby permitting the use of a thinner fibrous body wall layer. Preferably the line of perforations is discontinuous to define an imperforate portion of the label layer which is bonded in straddling relation across the helical butt joint contained in the fibrous body wall layer.

2 Claims, 8 Drawing Figures

Fig. 1
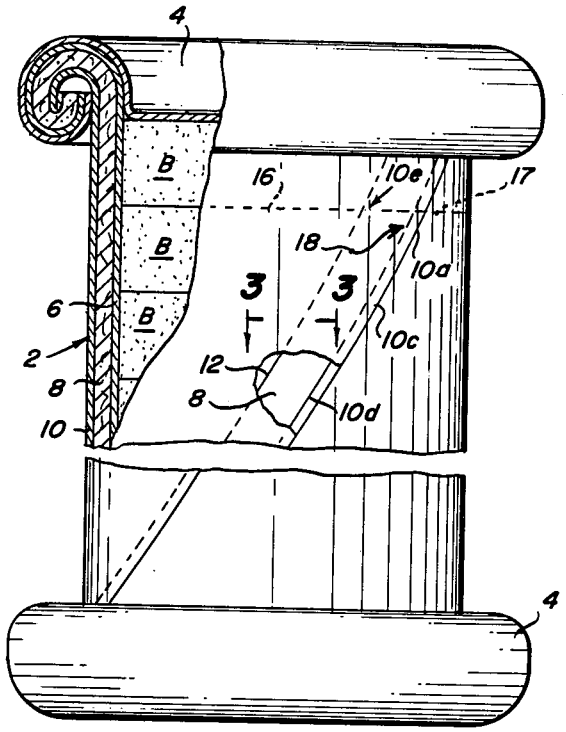
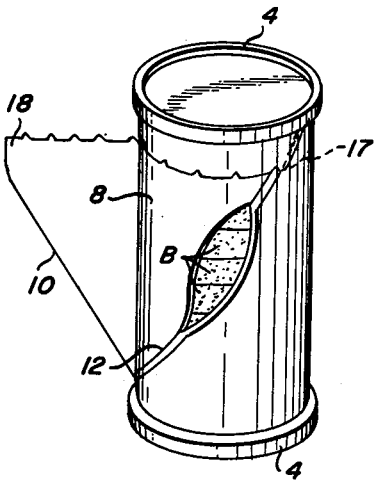
Fig. 2
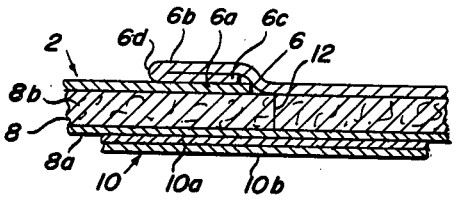
Fig. 3
Fig. 7
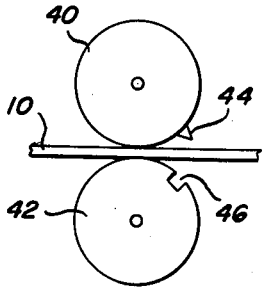

METHOD FOR FORMING A COMPOSITE CONTAINER INCLUDING A PERFORATED LABEL LAYER

BRIEF DESCRIPTION OF THE PRIOR ART

This is a division of application Ser. No. 789,084 filed Apr. 20, 1977.

The use of composite containers for packaging products such as biscuit dough and the like is well known in the patented prior art, as evidenced, for example, by the patents to Fienup et al U.S. Pat. No. 2,793,126 and Geist et al Nos. 2,793,127 and 3,144,193. As shown in the Geist et al U.S. Pat. No. 3,144,193, it is conventional in the art to provide in the outer surface of the tubular composite body wall adjacent one metal end closure member a continuous circumferential "collar" cut that extends completely through the label layer to define at one edge portion thereof a triangular-shaped pull tab portion. By means of this pull tab portion, the outer label layer may be removed from the container, whereupon the container is struck laterally against a sharp edge surface (of a kitchen counter or table, for example) to effect bursting of the body wall along the helical butt joint contained therein. In the Vallas U.S. Pat. Nos. 2,891,714 and 2,901,162, the outer concentric layer of a double-layer body wall contains a helical line of perforations which—after removal of the outer wrapper—is broken by a blow or the user's hand or thumb to initiate opening of the container. Finally, as shown in the Thornhill et al U.S. Pat. No. 3,981,433, a one-step easy-open container may be provided including an inner liner which contains a folded portion opposite the unbonded helical butt joint, whereby upon removal of the outer wrapper layer, the butt joint is expanded by the pressure of the packaged dough product to automatically effect bursting or tearing of the inner liner layer to afford access to the interior of the container.

One inherent drawback of composite containers including a collar cut is that during the formation of the collar cut in the label layer, quite often the cutting tool cuts also into the fibrous body wall layer (up to a depth of 0.010 inch or more), thereby materially weakening the composite container. In the case of the aforementioned one-step easy-open container, as disclosed in the Thornhill et al U.S. Pat. No. 3,981,433, the conventional collar cut is particularly undesirable, since the circumferential collar cut intersects the abutted edges of the helical seam of the fibrous body wall layer to produce a critically weak area adjacent the point of intersection. Thus, the inner liner layer is the only material holding the pressurized product in at that point. As a consequence of this drawback, it is customary to provide a fibrous body wall layer of substantial thickness, thereby materially increasing the cost of the container.

SUMMARY OF THE INVENTION

The present invention was developed to provide an improved composite container in which the necessity of a collar cut for defining the label layer pull tab is eliminated, whereby the use of a thinner fibrous body wall layer is permitted, thereby to effect a reduction in the cost of the container.

Accordingly, the primary object of the present invention is to provide an improved composite container—and, a method and apparatus for forming the same—including a label layer which is perforated prior to winding on the body wall layer to define a line of perforations that extends circumferentially in the label layer adjacent, spaced from and generally parallel with the metal end closure member, thereby to define a line of tear along which the label layer may be torn from the container.

According to a further object of the invention, the perforated line of tear may have different patterns in accordance with the type of container in connection with which the label layer is used. Thus, in the case of a one-step easy-open container the perforations may be arranged in a discontinuous pattern to define in the label layer an imperforate portion which is bonded in straddling relation across the unbonded butt joint, thereby to strengthen the label layer at this normal point of weakness of the container.

A more specific object of the invention is to provide novel perforating roller means for simultaneously forming the line of perforations in the label layer as the label layer is helically wound on the fibrous body wall layer.

BRIEF DESCRIPTION OF THE FIGURES

Other objects and advantages of the invention will become apparent from a study of the following specification when viewed in the light of the accompanying drawing, in which:

FIG. 1 is a partly sectioned side elevational view of the composite container of the present invention;

FIG. 2 is a perspective view of the container of FIG. 1 with the label layer partially torn away to expose the helical butt joint in the body wall layer, thereby effecting automatic opening of the container;

FIG. 3 is a detailed sectional view taken along line 3—3 of FIG. 1;

FIG. 7 is a detailed sectional view taken along the line 7—7 of FIG. 6.

DETAILED DESCRIPTION

Figure 4:
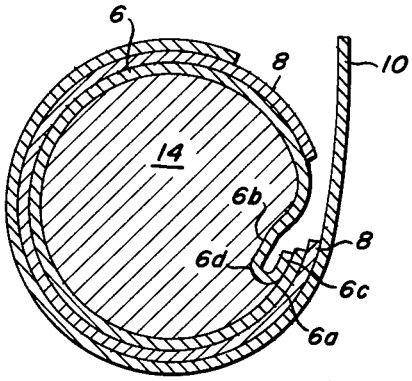
FIGS. 4 and 5 are cross-sectional views illustrating the manner in which the container automatically bursts or tears open upon removal of the label layer.

The composite container of the present invention includes a tubular composite body wall 2 the upper and lower ends of which are closed by conventional metal end closure members 4. The composite body wall layer includes an impervious inner layer 6, a fibrous body wall layer 8, and an outer label layer 10, which layers are helically wound in the same sense upon a mandrel and are adhesively bonded together by a conventional liquid adhesive (for example, a polyvinyl alcohol adhesive). More particularly, the impervious inner liner layer 6 is formed from a metal foil-kraft paper laminate, the paper layer of which is bonded to the fibrous body layer 8. Similarly, the outer label layer 10 may comprise a metal foil-kraft paper laminate, the paper layer **10*a* of which is bonded to the fibrous body wall layer 8, and the metal foil layer 10*b* of which is exposed and carries the printed advertising indicia. In order to assist tearing of the label layer from the fibrous body wall layer, the fibrous body wall layer 8 may include a surface portion 8*a* that is formed from reprocessed newspaper stock, the remaining portion 8*b* of the fibrous body wall layer 8** being formed of reprocessed kraft paper.

As in the invention disclosed in the aforementioned Thornhill et al U.S. Pat. No. 3,981,433, the adjacent edges of the helical butt joint 12 contained in the fibrous body wall layer 8 are unbonded, one edge portion 6a of the inner liner layer 6 terminating short of the butt joint. The other longitudinal edge portion of 6b of the inner liner layer 6 extends in straddling relationship across the butt joint and above the first edge portion 6a, said second edge portion being reversely folded back upon itself to define a third inner liner portion 6c that extends between the first and second liner portions 6a and 6b. The third liner portion 6c terminates short of the butt joint 12 and at least the free extremity thereof is bonded to the adjacent edge of the first edge portion 6a. Thus, the inner liner portion 6a, 6b and 6c define an expansible folded seam that straddles the unbonded butt joint 12 and isolates the same from the moisture of a product, such as leavened dough 14 in the form of a plurality of biscuits B.

Figure 5:
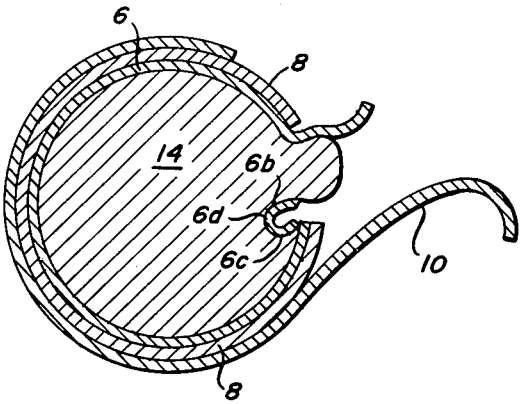
Figure 6:
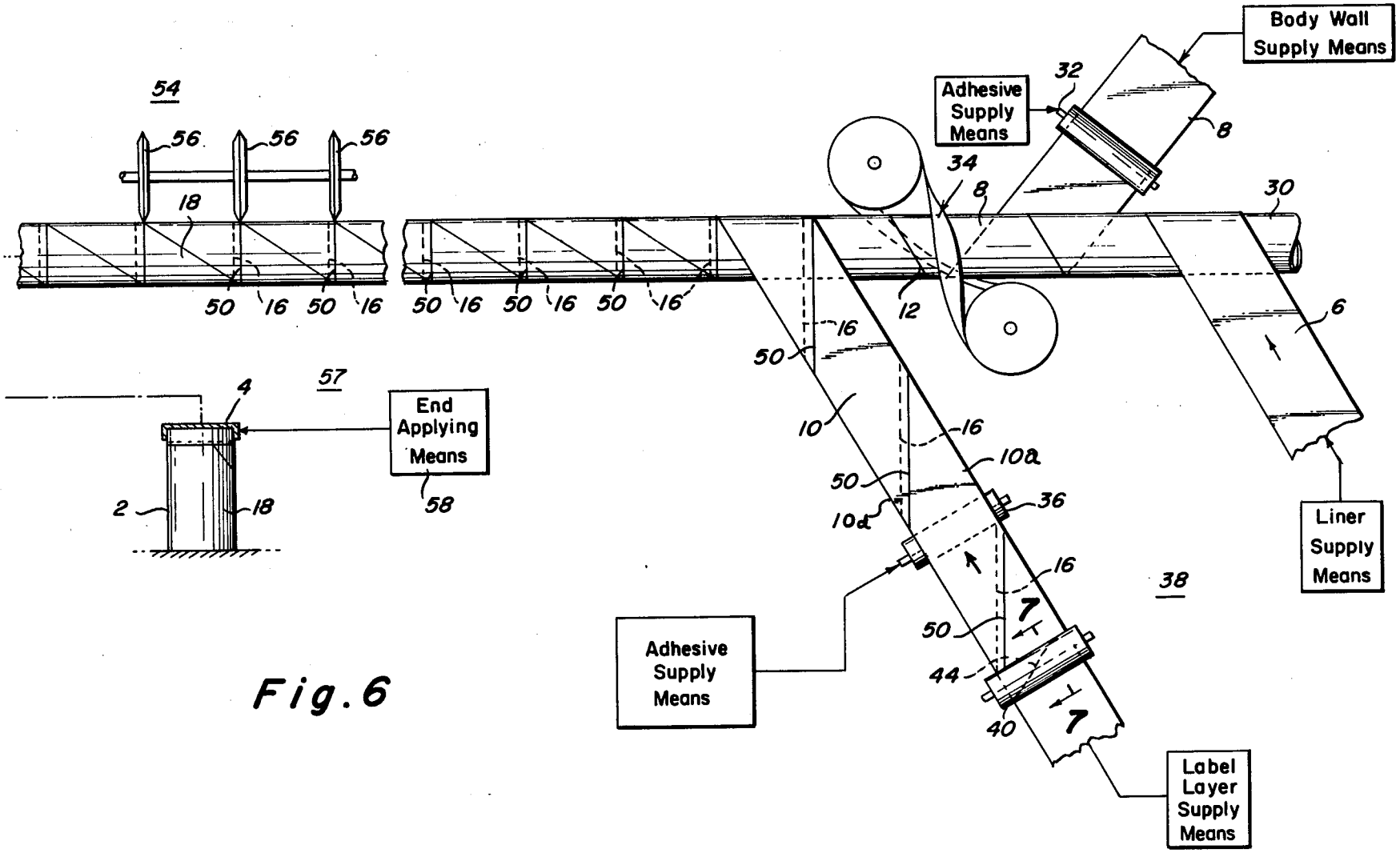
FIG. 6 is a diagrammatic illustration of the apparatus for producing the container of FIG. 1.

In accordance with the present invention, the label layer 10 is provided with a line of perforations 16 which is adjacent, spaced from and extends circumferentially generally parallel with the upper metal end portion 4, thereby defining in the label layer a perforated line of tear. As will be described below, the line of perforations starts at the overlapping edge 10a of the label layer and terminates at a point 17 adjacent, but spaced from, the underlying other longitudinal edge 10d of the label layer. As shown in FIGS. 2, 5 and 6, when the user pulls on the pull tab portion 18 defined in the overlapping edge 10a by the line of perforations, the label layer 10 is progressively torn from the body layer 8 along the line of perforations 16 to expose the unbonded helical butt joint 12, whereupon the pressure of the packaged dough product causes the mating edges of the butt joint to separate to permit progressive expansion of the inner layer 6. As shown in FIGS. 4 and 5, the inner liner 6 is caused to rupture either at a line of weakness defined by a creased fold line 6d, or by tearing the reversely folded third portion 6c progressively away from the inner liner first edge portion 6a. During this partial removal of the outer label layer 10, it is torn at its upper end along the circumferential perforated tear line 16 adjacent the upper metal end closure member 4 as shown in FIG. 2. After bursting of the container, the label layer 10 is further progressively removed until a sufficient portion of the butt joint 12 is exposed to permit the expansion thereof by twisting the metal end members 4 in opposite directions, thereby to further open the butt joint to permit the removal of the packaged products from the container.

Referring now to FIG. 6, it will be seen that the inner liner layer 6 is initially helically wound upon a stationary mandrel 30, and the fibrous body wall layer 8 has a layer of liquid adhesive applied to the upper surface thereof by an adhesive-applying roller 32 prior to the helical winding thereof upon the outer surface of the liner layer 6. The laminate of body wall and inner liner layers is longitudinally displaced to the left on the mandrel 30 by means of conventional belt conveying means 34.

The outer label layer 10 is fed longitudinally in edge-overlapping relation to the mandrel 30 and is coated on its lower surface with a layer of liquid adhesive by the adhesive supply means 36. In accordance with the present invention, prior to passing through the adhesive applying station, the label layer 10 passes through a perforating and cutting station 38 which includes rotary perforating and backup rollers 40 and 42, respectively. The perforating roller 40 has a plurality of pointed projections or needles 44 arranged in a generally helical pattern on the circumference thereof, and the backup roller contains a corresponding helical slot 46. The lines of perforations 16 extend from label layer edge 10a in a direction generally parallel with the lines of end cut 50 at which the tubular laminate is severed into sections, as will be described below.

The perforated label layer 10 is then wound helically in edge-overlapping adhesively bonded relation upon the outer surface of the body wall layer 8, whereupon the resulting laminate is conveyed by the belt conveyor means 34 toward a cutting station 54 including rotatably mounted knife means 46 that circumferentially cut the tubular laminate into cylindrical sections along circumferential cuts defined by the dividing lines 50. Alternatively, the laminate could be severed in desired longer lengths (for example, an eight-can length), and be removed from the mandrel 30 for severing into sections at another cutting station, as desired. In any event, the severed sections are transported to an end applying station 57 at which a metal end 4 is connected with the composite tubular body wall 2 by end applying means 58 in any conventional manner (for example, by the rolled seam illustrated in FIG. 1).

Figure 8:
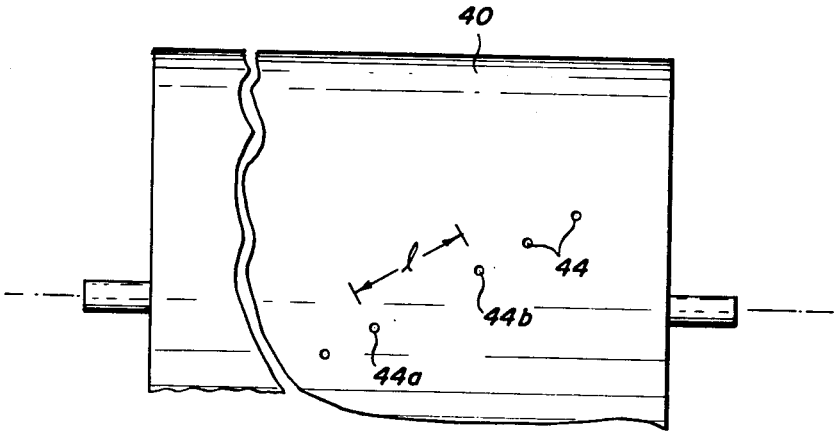
FIG. 8 is a detailed elevational view of the perforating and cutting roller.

In accordance with an important advantage of the invention, the perforating projections 44 may be arranged to afford a desired perforating pattern corresponding with the specific type of composite container being produced. Thus, as shown in FIG. 8, the line of perforations may be discontinuous, a space "1" being provided between the perforating members 44a and 44b to define in the outer label layer 10 an imperforate portion 10e that is bonded across the helical butt joint 12 in the body wall layer 8, thereby to strengthen the container at this normal point of weakness.

EXAMPLES

In the can manufacturing process, a spirally wound tube is formed by laminating a layer of paper board (97# basis weight) in combination with an aluminum foil inner liner around a stationary cylindrical mandrel. The inner liner (0.00035" aluminum and 30# basis kraft paper) is simultaneously heat sealed in a continuous spiral bond which provides the internal integrity of the final can, preventing or at least arresting the entrance/exit of moisture through this barrier. The last layer is generally a preprinted label (0.0003" aluminum foil and 40# basis kraft paper) which becomes the final outer wrap of the can. In the prior "collar cut" containers, this outer label layer is circumferentially cut with the cut extending not only through the label but also partially cutting into the fibrous body wall layer up to a depth of 0.010 inches or more. According to the present invention, by precutting the label layer with the lines of perforations, the use of collar cutting means is eliminated. Finally, 50# or 60# 2CR metal ends are attached to the can body by a rolled seam connection. Within this construction, the internal contents of a leavened dough is contained as long as the dough remains chemically stable and there is no degradation in the structure of the can itself.

This multiple layered can makes it possible to use extremely thin, high cost materials only where they are strategically required in the construction, thereby allowing the paperboard to be sandwiched in between these materials to build strength and rigidity into the can body wall. Consequently, a composite can of this construction is designed to withstand market conditions in relation to the chemical limitations of the internal dough product it must contain and the market environment in the refrigerated retail case.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. The method of manufacturing a composite container for dough products and the like, comprising the steps of (a) helically winding on a mandrel an impervious inner liner layer strip (6);

(b) helically winding a fibrous body wall layer strip (8) in the same sense as, and in adhesively bonded relation on the external surface of, said helically-wound inner liner layer, said body wall layer being wound to define a helical unbonded butt joint (12), and said liner layer including a helically extending folded expansible portion (6*a*, 6*b*) bonded to said body wall layer on both sides of, and extending in straddling relation across, said body wall helical butt joint, one edge portion (6*a*) of said liner layer terminating adjacent a first side of said body wall helical butt joint, the other edge portion of said liner layer having a first portion (6*b*) which extends from the other side of said butt joint across and beyond said butt joint, and a reversely folded second portion (6*c*) which extends between said one edge portion and said first portion back toward said butt joint, the length of said second portion extending substantially the length of said first portion and terminating adjacent the edge of said one edge portion, the fold line (6*d*) between said first and second liner portions extending helically the length of the laminate section, the outer surface of said reversely folded second liner portion (6*c*) being secured to the inner surface of said liner layer one edge portion to permit relative expansion of said first and second liner portions;

(c) forming a succession of longitudinally-spaced generally transversely extending lines of perforations (16) in a label layer strip (10), each of said lines of perforations extending from one longitudinal edge (10*a*) of the label layer strip and terminating adjacent the other longitudinal edge (10*b*) of the label layer strip, each of said lines of perforations being discontinuous to define in said label layer an imperforate portion (10*e*);

(d) helically winding the label layer strip in the same sense as, and in adhesively-bonded relation on the external surface of, said body wall layer, thereby to form a tubular laminate, said label layer being wound in edge-overlapping relation with said one edge portion (10*a*) being exposed, said imperforate portions extending in straddling relation across said body wall layer butt joint;

(e) transversely cutting the tubular laminate along longitudinally spaced lines of circumferential end cuts (50) contained in planes normal to the longitudinal axis of the tubular laminate, thereby to define a plurality of cylindrical laminate sections, each of said lines of perforations being adjacent, spaced from and generally parallel with the associated circumferential end cut; and (f) fastening to the end of the laminate section adjacent the line of perforations a metal end closure member (4), whereby the label may be torn from the container assembly along a circumferential perforated tear line adjacent the metal end closure member, and further whereby upon removal of said label layer from the container, the butt joint is expanded by the pressurized packaged product to automatically open the liner layer by shearing or tearing.

2. The method as defined in claim 1, wherein each of the lines of perforations terminates at a point (17) in spaced relation to said other longitudinal edge (10*b*) of the label layer strip.

* * * * *